US008974014B1

(12) United States Patent
Tiemann et al.

(10) Patent No.: US 8,974,014 B1
(45) Date of Patent: Mar. 10, 2015

(54) DRAWER FOR HOLDING BEVERAGE CARTRIDGES

(71) Applicant: Nifty Home Products, Inc., Madison Lake, MN (US)

(72) Inventors: Frank R. Tiemann, Madison Lake, MN (US); Richard W. Vogelgesang, II, Madison Lake, MN (US); Todd M. Hertaus, New Market, MN (US); Nicholas J. Teigland, Mankato, MN (US)

(73) Assignee: Nifty Home Products, Inc., Madison Lake, MN (US)

( * ) Notice: Subject to any disclaimer, the term of this patent is extended or adjusted under 35 U.S.C. 154(b) by 0 days.

(21) Appl. No.: 14/212,806

(22) Filed: Mar. 14, 2014

(51) Int. Cl.

| | |
|---|---|
| ***A47B 91/00*** | (2006.01) |
| ***A47B 46/00*** | (2006.01) |
| ***A47B 88/20*** | (2006.01) |
| ***A47B 88/04*** | (2006.01) |

(52) U.S. Cl.
CPC ..... *A47B 88/20* (2013.01); *A47B 88/0418* (2013.01); *A47B 88/0466* (2013.01); *A47B 2088/0444* (2013.01)
USPC ..... 312/351.1; 211/71.01; 248/676

(58) Field of Classification Search
CPC ..... A47B 46/00; A47B 77/16; A47B 88/18; A47B 91/005; A47B 2210/15
USPC ..... 312/294, 257.1, 330.1, 351.1, 351.11, 312/334.1, 334.27; 248/637, 676, 678, 133; 211/71.01, 74, 79, 80, 81
See application file for complete search history.

(56) References Cited

U.S. PATENT DOCUMENTS

| | | | | |
|---|---|---|---|---|
| 921,694 | A | 5/1909 | Hall | |
| 3,259,432 | A * | 7/1966 | Jackson | 297/354.1 |
| 4,192,564 | A * | 3/1980 | Losert | 312/351.11 |
| 4,947,991 | A * | 8/1990 | Snell | 206/427 |
| 5,133,939 | A * | 7/1992 | Mahe | 422/562 |
| 5,590,938 | A * | 1/1997 | De Andrea | 312/257.1 |
| 5,785,293 | A * | 7/1998 | Ford et al. | 248/649 |
| D433,711 | S | 11/2000 | Andujar | |
| 6,390,627 | B1 * | 5/2002 | Kuroda | 353/119 |
| 6,840,593 | B2 | 1/2005 | Remmers | |
| D525,488 | S | 7/2006 | McWhorter | |
| D547,094 | S | 7/2007 | Klein et al. | |
| D628,444 | S | 12/2010 | Snider | |
| D628,445 | S | 12/2010 | Snider | |
| D635,363 | S | 4/2011 | Hertaus | |
| D635,765 | S | 4/2011 | Hertaus | |
| D643,686 | S | 8/2011 | Tiemann | |
| D644,069 | S | 8/2011 | Tiemann | |
| D659,481 | S | 5/2012 | Tiemann | |

(Continued)

OTHER PUBLICATIONS

"Smart Works Keurig K Cup Coffee Pod Drawer Holds 35 Pods Chrome Finish Glass Top", ebay.com, Apr. 7, 2014.

*Primary Examiner* — James O Hansen
(74) *Attorney, Agent, or Firm* — Thomas J. Nikolai; Nikolai & Mersereau, P.A.

(57) ABSTRACT

A stand for a single-cup beverage brewer incorporates a beverage cartridge storage drawer and incorporates a lever mechanism which, when actuated, simultaneously lifts a plurality of elastomeric friction pads from contacting a support surface, such as a kitchen countertop, while supporting the assembly on rollers to facilitate moving the stand and beverage brewer supported thereon. Release of the lever again brings the friction pads into contact with the countertop to function as a brake.

10 Claims, 3 Drawing Sheets

(56) References Cited

U.S. PATENT DOCUMENTS

| | | | | |
|---|---|---|---|---|
| D660,088 | S | 5/2012 | Tiemann | |
| D660,652 | S | 5/2012 | Tiemann | |
| D661,951 | S | 6/2012 | Tiemann | |
| D680,380 | S | 4/2013 | Tiemann | |
| D682,039 | S | 5/2013 | Tiemann | |
| D682,040 | S | 5/2013 | Tiemann | |
| D686,464 | S | 7/2013 | Tiemann | |
| D691,858 | S | 10/2013 | Tiemann | |
| D701,733 | S | 4/2014 | Tiemann | |
| D703,002 | S | 4/2014 | Tiemann | |
| D703,003 | S | 4/2014 | Tiemann | |
| D703,005 | S | 4/2014 | Tiemann | |
| 2004/0174105 | A1* | 9/2004 | Hung | 312/351.1 |
| 2005/0205578 | A1 | 9/2005 | Yeh | |
| 2007/0221817 | A1* | 9/2007 | Chen | 248/676 |

* cited by examiner 67
72
24
84
16
70
18
84
26
20
80
28
82
74
46
88
56
46
68

DRAWER FOR HOLDING BEVERAGE CARTRIDGES

CROSS REFERENCE TO RELATED APPLICATIONS

None

BACKGROUND OF THE INVENTION

I. Field of the Invention

This invention relates generally to kitchen appliances and more particularly to a stand for a beverage brewer of the type using single cup cartridges and that facilitates movement of the stand and beverage brewer on a countertop and which provides a drawer for storage of a supply of beverage cartridges.

II. Discussion of the Prior Art

A currently popular kitchen appliance is a single-cup beverage brewer made by Green Mountain Coffee Roasters, Inc. and marketed under the Keurig brand. It utilizes small, single-use, disposable beverage cartridges called K-Cups® which, when inserted into the brewer, become punctured so that a stream of water may pass through it and into a drinking cup.

In order to insert a cartridge into the brewer, it is necessary to lift a handle on the brewer to expose a chamber in which the cartridge is inserted. When the brewer is placed on a kitchen counter beneath overhead cabinets, there is often not sufficient overhead clearance to permit the brewer's lever to be lifted. This necessitates sliding the brewer forward on the countertop to bring it out from under the overhead cabinet. Care must be exercised in doing so to prevent the brewer from passing over the front edge of the countertop and falling to the floor.

A supply of beverage cartridges should be located proximate the brewer for the sake of convenience. The prior art includes carousel devices having a stacked arrangement of rings designed to hold beverage cartridges. Also, portable drawers of a size to fit atop a kitchen counter have been designed for storing such beverage cartridges. In this regard, reference is made to U.S. Design Patents D691,858, D680,380 and D686,464 owned by applicants' assignee, Nifty Home Products, Inc. of Madison Lake, Minn. These drawer devices are designed so that a beverage brewer may be placed on its top surface, but this makes it somewhat awkward to move the combination brewer and drawer from beneath an overhead cabinet.

A need therefore exists for a beverage cartridge storage drawer that is easy to move and that affords added safety to prevent accidental movement of the storage drawer and brewer beyond the edge of a countertop.

SUMMARY OF THE INVENTION

In accordance with the present invention, a stand and storage drawer for a beverage dispenser comprises a base member of a rectangular wire frame defining a front, a rear and left and right sides. The base member further includes first and second wire rails extending parallel to one another from the frame front to the frame rear where the first and second wire rails are inwardly offset from the left and right sides. The base member further includes first and second pairs of wire guide rails that also extend parallel to one another from the frame front to the frame rear and with a predetermined spacing between the wire guide rails of each pair.

Affixed to the underside of the wire frame proximate the intersection of the left and right frame sides with the front side are elastomeric friction pads. Further, a pair of rollers is affixed to the underside of the wire frame proximate the intersection of the left and right frame sides with the rear frame side. The rollers are journaled for rotation about axes that are parallel to the rear frame side.

Disposed between and affixed to the first and second wire rails is a plate member on which is mounted a manually actuable lever. The lever, when actuated, functions to tip the base member at an angle with respect to a support surface such that the friction pads no longer contact the support surface and only the rollers remain in contact with the support surface.

A planar top surface member is vertically offset from the base member by corner posts extending perpendicular to the base member proximate the intersection of the left and right frame sides with the front and rear frame sides. Disposed in the space between the base member and the top surface is a drawer that is slidable in and out of this space and that is guided by the aforementioned first and second pairs of wire guide rails. The drawer is partitioned by a plurality of rectangular straps to support beverage cartridges in an orderly arrangement. By pressing down on the lever, the front portion of the stand is elevated so that the elastomeric friction pads no longer touch a countertop. Instead, the assembly is fully supported by the wheels, allowing a user to readily move the stand and an accompanying brewer on a countertop. When the lever is again released, the friction pads resist further movement of the assembly.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENTS

Figure 1:
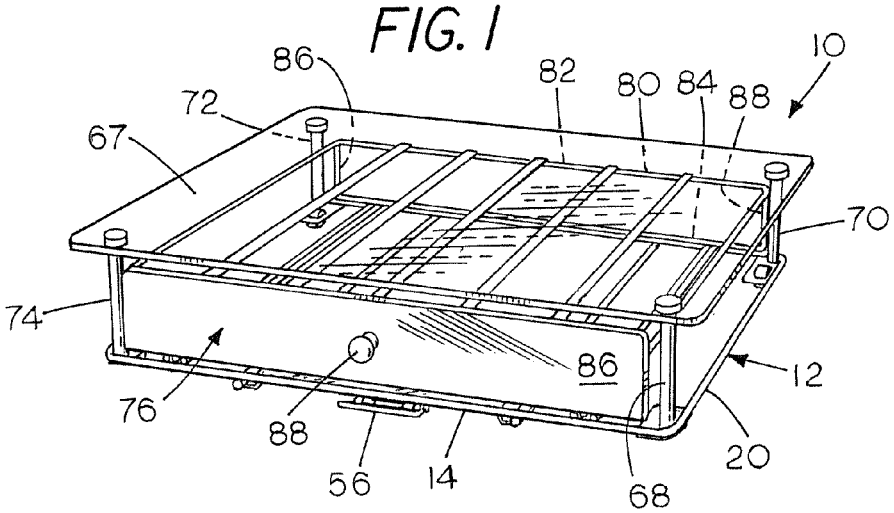
FIG. 1 is a perspective view of a preferred embodiment of the stand and storage drawer for use with a beverage dispenser where the drawer is closed.

This description of the preferred embodiments is intended to be read in connection with the accompanying drawings, which are to be considered part of the entire written description of this invention. In the description, relative terms such as "lower", "upper", "horizontal", "vertical", "above", "below", "up", "down", "top" and "bottom" as well as derivatives thereof (e.g., "horizontally", "downwardly", "upwardly", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "join" and "joining" are used interchangeably and refer to one structure or surface being secured to another structure or surface or integrally fabricated in one piece, unless expressively described otherwise.

Referring to FIG. 1, there is indicated generally by numeral 10 a stand and storage drawer for a beverage dispenser embodying the present invention. It is seen to comprise a base member 12 comprising a rectangular wire frame defining a front 14, a rear 16 (FIG. 3), a left side 18 and a right side 20. First and second wire rails 22 and 24 are affixed to the underside of the frame by welding and those wire rails 22 and 24 extend parallel to one another from the frame front 14 to the frame rear 16. The wire rails 22 and 24 are shown as being offset inwardly by equal amounts from their respective left side 18 and right side 20.

Figure 4:
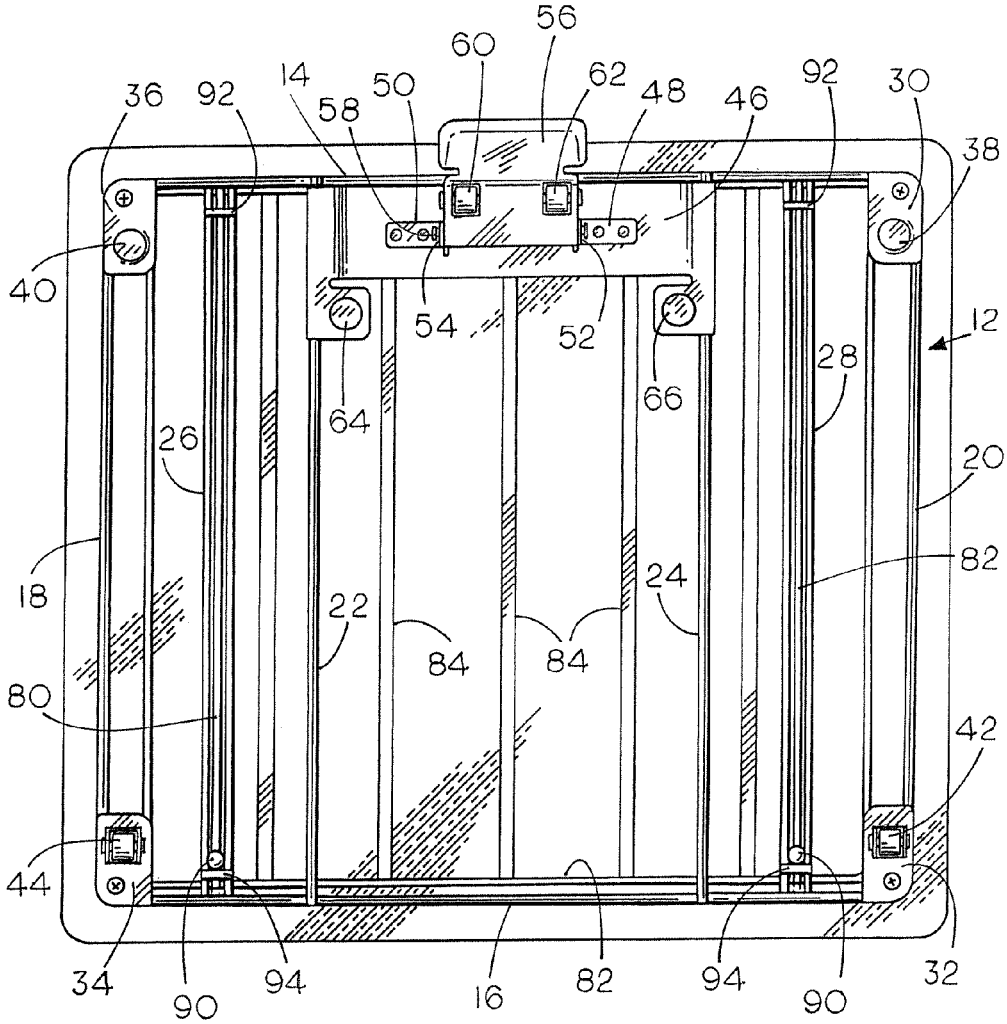
FIG. 4 is a bottom view thereof.

Also seen in the bottom view of FIG. 4 is a first pair of wire guide rails 26 and a second pair of wire guide rails 28. These guide rails are affixed to the top side of the frame 12 by spot welding and again extend between the frame front 14 and the frame rear 16. The members of the pairs of guide rails are spaced apart from one another by a predetermined spacing.

Affixed to the bottom of the frame 12 at its four corners are mounting plates 30, 32, 34 and 36, and affixed to the exposed bottom surface of the corner plates 30 and 36 proximate the front of the frame are elastomeric friction pads 38 and 40. Journaled for rotation on the corner plates 32 and 34 are rollers 42 and 44 that rotate about an axis that extends parallel to the frame rear 16.

With continued reference to FIG. 4, there is seen a plate member 46 that extends between and is permanently attached at opposite ends to the first and second wire rails 22 and 24. Riveted to the plate 46 are L-shaped brackets 48 and 50. Fitted between the downwardly projecting legs 52 and 54 of the brackets 48 and 50 is a lever 56 mounted on an axle 58 that extends through aligned holes in the legs 52 and 54, allowing the lever 56 to pivot when depressed.

Journaled for rotation on the lever 56 are rollers 60 and 62. Also seen in the bottom view of FIG. 4 are elastomeric friction pads 64 and 66.

Figure 3:
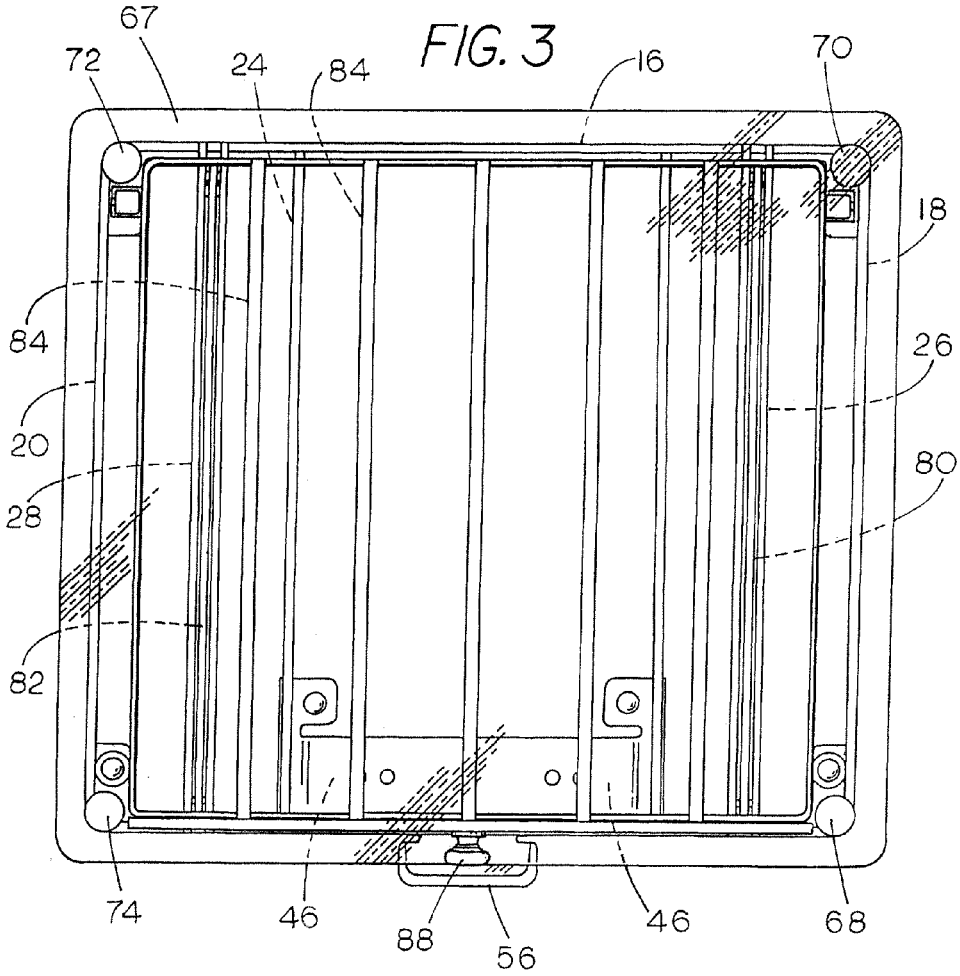
FIG. 3 is a top view of the embodiment of FIG. 1.

With reference again to FIG. 1, there is seen a planar top surface member 67, preferably made of a decorative smoked glass, that is offset from the base 12 by corner posts 68, 70, 72 and 74. These corner posts extend perpendicular to the base member and are proximate the intersections of the left and right frame sides 18 and 20 with the front and rear frame sides 14 and 16. Fitted between the base member 12 and the top surface member 67 is a drawer indicated generally by numeral 76. The drawer 76 is designed so as to fit in the space between the base member 12 and the top surface member 67 and is slidable in and out of the space, with its movement being guided by the first and second pairs of wire guide rails 26 and 28 (FIG. 3).

Figure 2:
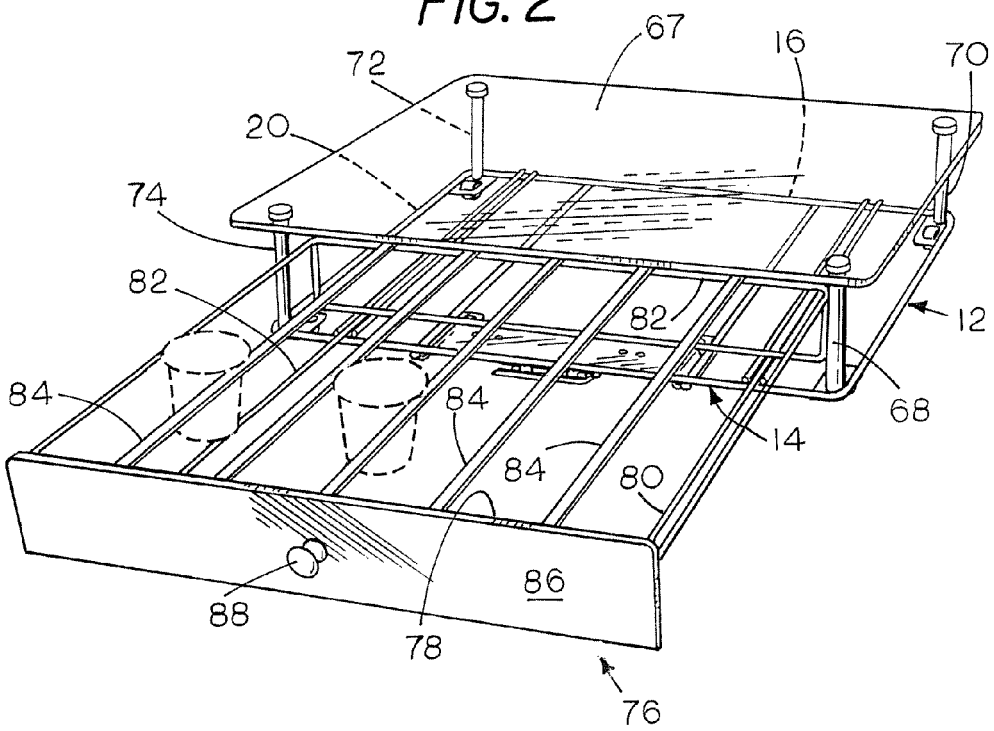
FIG. 2 is a perspective view like that of FIG. 1 but with the drawer open.

The drawer itself is seen to comprise a front and a rear vertically oriented rectangular frame member 78 and 80, each with an upper wire 82, a lower wire 84 and left and right side wires 86 and 88. As best seen in FIG. 2, the lower wire of the front rectangular frame member is joined by first and second parallel, spaced-apart wire drawer rails 80 and 82 which are positioned so as to fall between and be constrained to rectilinear movement by the guide rail pairs 26 and 28.

As is seen in FIG. 2, a plurality of rectilinear straps 84 are spot-welded to the upper wires of the front and rear rectangular frame members 78 and 80. The lateral spacing between the straps 84 is such that they will engage a radial flange found on beverage cartridges and as shown in phantom in FIG. 2. Thus, the cartridges are suspended by virtue of the spacing between adjacent ones of the straps 84. A decorative face plate 86 is spot-welded to the drawer's front rectangular frame member and a pull knob 88 is provided to aid in opening the drawer from the position shown in FIG. 1 to that shown in FIG. 2. The face plate preferably has a polished chrome finish for esthetic purposes.

With reference again to FIG. 4, spherical retainers 90 are spot-welded to the guide rails 80 and 82 and the diameter of the retainer members 90 is slightly greater than the spacing between members of the guide rail pairs 26 and 28, allowing the drawer rails 80 and 82 to slide between the wire guide rails 26, 28, but not be removable. Also welded to the members of the guide wire pairs 26 and 28 are front and rear stops 92 and 94, respectively. When opening the drawer, the spherical retainers 90 will abut the stops 92 to prevent the drawer from being opened further. Similarly, when closing the drawer, the stops 94 will engage the spherical retainer 90 so that the face plate 86 will be flush with the frame front.

In operation, a selection of coffee cartridges that have been loaded onto the straps 84 of the drawer 76 will reside within the stand 10 and an electric brewer will be supported on the top member 67 and will typically be pushed back against a backsplash of a kitchen counter so as to be beneath overhead cabinets when not being used. When it is desired to brew a beverage, the operator will depress the lever 50 and, in doing so, will elevate the front end portion of the stand 10 so that the elastomeric friction members 38, 40, 64 and 66 will no longer be in contact with the counter surface. Instead, the stand with the brewer atop will be supported on the rollers 42, 44, 60 and 62, allowing the operator to readily roll the stand and brewer from its location beneath the kitchen cabinets to a forward position on the counter. Immediately, upon release of the lever 56, the front end portion of the stand 10 will drop so that the elastomeric friction members 38, 40, 64 and 66 will again come in contact with the countertop to resist any further forward motion and preventing the assembly from rolling off the countertop. The user may then slide open the drawer 76 and select a beverage cartridge and insert it into the brewer's cartridge chamber and initiate a brewing cycle. Upon completion, the user may again depress the lever 56 and roll the stand and brewer back against the counter's backsplash.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and be used with a variety of brewer models. Also, various modifications, both as to the equipment and operating procedures, can be accomplished without departing from the scope of the invention itself.

What is claimed is:

1. A stand and storage drawer for a beverage dispenser comprising:

a) a base member comprising a rectangular wire frame defining a front, a rear and left and right sides, first and second wire rails affixed to an underside of the frame and extending parallel to one-another from the frame front to the frame rear and the first and second wire rail inwardly offset from the left and right sides respectively, the base member further including first and second pairs of wire guide rails affixed to a top side of the frame and extending parallel to one another from the frame front to the frame rear with a predetermined spacing between the wire guide rails of each pair;

b) first and second elastomeric friction pads affixed to the underside of the wire frame proximate intersections of the left and right frame sides with the front side;

c) a pair of rollers affixed to the underside of the wire frame proximate the intersections of the left and right frame sides with the rear frame side, the rollers being journaled for rotation about axes that are parallel to the rear frame side;

d) a plate member extending between the first and second wire rails;

e) a manually actuatable lever pivotally attached to an underside of the plate member which when actuated tips the base member at an angle with respect to a support surface such that the friction pads come out of contact with the support surface and only the rollers remain in contact with the support surface;

f) a planar top surface member offset from the base member by corner posts extending perpendicular to the base member proximate the intersections of the left and right frame sides with the front and rear frame sides; and g) a drawer disposed in a space between the base member and the top surface member and slidable in and out of said space and guided by the first and second pairs of wire guide rails.

2. The stand and storage drawer as in claim 1 and further including:

a) a pair of rollers mounted on the lever and journaled for rotation on an axis parallel to the front frame side, the pair of rollers only contacting the support surface upon actuation of the lever.

3. The stand and storage drawer as in claim 2 and further including third and fourth elastomeric friction pads affixed to the underside of the plate member.

4. The stand and storage drawer of claim 1 wherein the top surface member is a glass plate.

5. The stand and storage drawer of claim 1 wherein the drawer comprises:

a) front and rear rectangular frame members, each having an upper wire, a lower wire and left and right side wires where the lower wire of the front rectangular frame member is joined by first and second parallel, spaced-apart wire drawer rails to the lower wire of the rear frame member; and b) a plurality of rectilinear straps joining the upper wires of the drawer's front and rear rectangular frame members, the plurality of straps being parallel to one another and regularly spaced apart with a predetermined spacing therebetween.

6. The stand and storage drawer of claim 5 and further including a face plate affixed in covering relation to the front frame member.

7. The stand and storage drawer of claim 5 wherein the first and second drawer rails reside between the wire guide rails of the first and second pairs of guide rails on the base member when the drawer is being slid in and out of said space.

8. The stand and storage drawer of claim 7 and further including retainers affixed to the drawer rails for preventing separation of the drawer from the base member while permitting the drawer to slide relative to the base member.

9. The stand and storage drawer of claim 8 where the retainers are spheres of a diameter greater than said predetermined spacing between the wires comprising the first and second pairs of wire guide rails.

10. The stand and storage drawer as in claim 9 and further including stop members spanning a gap between the wires comprising the first and second pairs of wire guide rails, the stop members cooperating with the retainers for preventing total extraction of the drawer from said space.

* * * * *